US010722008B2

(12) United States Patent
Yun

(10) Patent No.: US 10,722,008 B2
(45) **Date of Patent: *Jul. 28, 2020**

(54) DEVICE AND METHOD FOR OUTPUTTING IMAGE ONTO SURFACE OF JEWEL BY USING PRE-DISTORTED IMAGE

(71) Applicant: Sun-Yong Yun, Seoul (KR)

(72) Inventor: Sun-Yong Yun, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/415,304

(22) Filed: May 17, 2019

(65) Prior Publication Data

US 2019/0269208 A1 Sep. 5, 2019

Related U.S. Application Data

(63) Continuation of application No. 15/747,428, filed as application No. PCT/KR2016/006908 on Jun. 28, 2016, now Pat. No. 10,314,372.

(30) Foreign Application Priority Data

Jul. 31, 2015 (KR) ..... 10-2015-0109194

(51) Int. Cl.

| | |
|---|---|
| ***A44C 17/00*** | (2006.01) |
| ***A44C 15/00*** | (2006.01) |
| ***B44C 1/00*** | (2006.01) |
| *A44C 17/02* | (2006.01) |

(52) U.S. Cl.

CPC ..... *A44C 17/00* (2013.01); *A44C 15/0015* (2013.01); *B44C 1/00* (2013.01); *A44C 17/02* (2013.01)

(58) Field of Classification Search

None

See application file for complete search history.

(56) References Cited

U.S. PATENT DOCUMENTS

| | | | |
|---|---|---|---|
| 2008/0184739 | A1 | 8/2008 | Huynh |
| 2016/0270656 | A1 | 9/2016 | Samec et al. |

(Continued)

FOREIGN PATENT DOCUMENTS

| | | | |
|---|---|---|---|
| EP | 1365830 | B1 | 4/2012 |
| JP | 2004147834 | A | 5/2004 |
| JP | 2010123007 | A | 6/2010 |

(Continued)

OTHER PUBLICATIONS

International Search Report and Written Opinion dated Sep. 30, 2016, for PCT Application No. PCT/KR2016/006908 (including English Translated ISR).

(Continued)

*Primary Examiner* — Kyle Zhai

(74) *Attorney, Agent, or Firm* — Dorsey & Whitney LLP

(57) ABSTRACT

Disclosed herein are an apparatus and method for displaying an image on the surface of a jewel using a previously distorted image. The apparatus for displaying an image on a surface of a jewel using a previously distorted image includes a distorted image generation unit for generating a distorted image corresponding to an original image that is desired to be displayed on a table facet of a jewel in consideration of characteristics of the jewel and characteristics of the original image, and a display unit for outputting visible light corresponding to the distorted image to the jewel so that the original image is displayed on the table facet of the jewel.

8 Claims, 22 Drawing Sheets

(56) References Cited

U.S. PATENT DOCUMENTS

| | | | |
|---|---|---|---|
| 2016/0377271 | A1 | 12/2016 | Kelly et al. |
| 2018/0213897 | A1 | 8/2018 | Yun |

FOREIGN PATENT DOCUMENTS

| | | | |
|---|---|---|---|
| KR | 100896783 | B1 | 4/2009 |
| KR | 1020120012272 | A | 2/2012 |
| KR | 1020140018591 | A | 2/2014 |
| KR | 101425550 | B1 | 8/2014 |

OTHER PUBLICATIONS

U.S Appl. No. 15/747,428 entitled 'Device and Method for Outputting Image Onto Surface of Jewel by Using Pre-Distorted Image' filed Jan. 24, 2018.

| | | | |
|---|---|---|---|
| EST.WEIGHT | | 1.720 Ct. | |
| DIAMETER(mm) | | 7.74(7.73-7.75)[0.3%] | |
| TOTAL DEPTH | % | 61.0 4.72mm | |
| CROWN ANGLE | ' | 34.4(34.3-34.5) | 0 |
| CROWN HEIGHT | % | 15.3(15.0-15.5) | |
| PAVIL ANGLE | ' | 40.8(40.6-41.0) | |
| PAVIL DEPTH | % | 42.7(42.6-42.9) | 0 |
| CULET | % | 0.1 None | 0 |
| TABLE SIZE | % | 56.1(55.9-56.4) | 0 |
| GIRDLE THICKNESS | | 1.7%(1.5-1.9) Medium | 0 |
| PROPORATION | | 0 | |

| | 0 | 1 | 2 | 3 | 4 |
|---|---|---|---|---|---|
| C.Angle | 33.7 35.8 | 32.7 36.3 | 32.7 36.8 | 31.2 37.8 | 39.7 39.3 |
| C.Height | 0.0 99.0 | 0.0 99.0 | 0.0 99.0 | 0.0 99.0 | 0.0 99.0 |
| P.Angle | 0.0 89.0 | 0.0 89.0 | 0.0 89.0 | 0.0 89.0 | 0.0 89.0 |
| P.Depth | 42.2 43.8 | 42.2 44.3 | 41.7 44.8 | 41.2 45.3 | 40.2 46.8 |
| Culet | 0.0 3.8 | 0.0 4.6 | 0.0 4.6 | 0.0 8.1 | 0.0 12.6 |
| Table | 62.4 57.5 | 51.4 59.5 | 51.4 61.5 | 50.4 65.5 | 48.4 71.5 |
| T.Depth | 0.0 99.0 | 0.0 99.0 | 0.0 99.0 | 0.0 99.0 | 0.0 99.0 |
| Girdle | 0.5 3.0 | 0.1 3.0 | 0.1 3.0 | 0.1 4.2 | 0.0 6.2 |

| Category | Characteristics |
|---|---|
| Chemical component/crystal system | C/isometric system |
| Color | Chiefly classified into traditional color range from colorless to light yellow, light brown, and light gray, and range of fancy color diamond |
| Transparency | TP-O (transparent-opaque) |
| Luster | Adamantine luster (highest luster of transparent jewels) |
| Refractive index | 2.417/OTL (exceeding limit) |
| Polarization | SR |
| Ultraviolet fluorescence | Appear to be from reactionless to stronger in direction from colorlessness to yellow (generally, when blue is assumed, fluorescence is stronger at long wavelength than at short wavelength |
| Gravity | 3.52(+0.01/-0.01) |
| Hardness | 10 |

FIG. 5

| Category | Characteristics |
|---|---|
| Chemical component/crystal system | $Al_2O_3$/trigonal system (hexagonal system) |
| Color | Red |
| Transparency | TP-O |
| Luster | Glass luster - Sub-adamantine luster |
| Refractive index | 1.762-1.770(+0.009/-0.005) |
| Polarization/optical sign | DR/U- |
| Polychroism | Dichroism |
| Ultraviolet fluorescence | Strong red fluorescent reaction appears both at long wavelength and short wavelength, and chalky fluorescence may occur in heat-treated ruby |
| Gravity | 4.00(+0.10/-0.05) |
| Hardness | 9 |

FIG. 6

| Category | Characteristics |
|---|---|
| Chemical component/crystal system | $Al_2O_3$/trigonal system (hexagonal system) |
| Color | All colors except red |
| Transparency | TP-O |
| Luster | Glass luster - Sub-adamantine luster |
| Refractive index | 1.762-1.770(+0.009/-0.005) |
| Amount of double refraction | 0.008-0.010 |
| Polarization/optical sign | DR/U- |
| Polychroism | Dichroism |
| Ultraviolet fluorescence | Fluorescence is typically reactionless in blue, and is possible from red to orange at long wavelength. Further, weak reaction in chalky blue or greenish yellow at short wavelength indicates heat treatment |
| Gravity | 4.00(+0.10/-0.05) |
| Hardness | 9 |

FIG. 7

| Category | Characteristics |
|---|---|
| Chemical component/crystal system | $Be_3Al_2Si_6O_{18}$/hexagonal system |
| Color | Green |
| Transparency | TP-TL |
| Luster | Glass luster |
| Refractive index | 1.557-1.583(+0.017/-0.017) |
| Amount of double refraction | 0.005-0.009 |
| Polarization/optical sign | DR/U- |
| Polychroism | Dichroism |
| Ultraviolet fluorescence | Fluorescence is typically reactionless, but very high quality color exhibits fluorescent reaction from orange red to red both at long wavelength and short wavelength (stronger reaction is typically exhibited at long wavelength) |
| Gravity | 2.72(+0.18/-0.05) |
| Hardness | 7.5-8 |

FIG. 8

| Category | Characteristics |
|---|---|
| Chemical component/crystal system | $SiO_2$/trigonal system (hexagonal system) |
| Color | Purple |
| Transparency | TP |
| Luster | Glass luster |
| Refractive index | 1.544-1.553 (very constant) |
| Polarization/optical sign | DR/U+ |
| Polychroism | Dichroism |
| Ultraviolet fluorescence | Typically reactionless |
| Gravity | 2.66(+0.03/-0.02) |
| Hardness | 7 |

FIG. 9

DEVICE AND METHOD FOR OUTPUTTING IMAGE ONTO SURFACE OF JEWEL BY USING PRE-DISTORTED IMAGE

CROSS REFERENCE TO RELATED APPLICATION(S)

This application is a continuation of U.S. patent application Ser. No. 15/747,428 filed Jan. 24, 2018, which is a 35 U.S.C. § 371 National Stage Application of PCT Application No. PCT/KR2016/006908 filed Jun. 28, 2016, which application is based upon and claims the benefit of priority from Korean Patent Application No. 10-2015-0109194 filed on Jul. 31, 2015. The aforementioned U.S. applications and patent, and the disclosure of Korean Patent No. 10-2015-0109194 are incorporated herein in their entirety by resume.

TECHNICAL FIELD

The present invention generally relates to technology for displaying an image on the surface of a jewel and, more particularly, to technology for displaying an image can the surface of a jewel using a previously distorted image in consideration of the characteristics of the jewel and the characteristics of the original image in order to prevent the image from being distorted due to the characteristics of the jewel.

BACKGROUND ART

Recently, with the development of the economy, interest in jewelry has increased regardless of age or gender. In particular, jewelry, which used to be popular among higher-income groups, has become popular among middle-income groups in addition to higher-income groups due to the frequent exposure of jewelry through the mass media.

However, since technology for displaying an image, such as a still image or a moving image, on the surface of a jewel has not yet been developed, this technology does not attract attention. In particular, a jewel is subjected to a phenomenon in which light is transformed while passing through the interior of the jewel due to the characteristics of the jewel, such as the refractive index thereof, and in which an image displayed on the surface of the jewel is displayed in a distorted manner.

Korean Patent Application Publication No. 2012-0012272 discloses an image processing apparatus having a distorted image correction function. In particular, this patent discloses technology for calculating horizontal and vertical coordinates at the location at which distortion correction is to be performed so as to correct an image distorted by a lens, and for correcting a distorted image using both the coordinates and a correction formula.

However, Korean Patent Application Publication No. 2012-0012272 is disadvantageous in that it merely discloses technology for correcting a previously captured image using software, but cannot be applied to technology for displaying an original image on the surface of a jewel. Further, there is a fatal disadvantage in that not all characteristics of a jewel, such as the refractive index and the color thereof, are taken into consideration.

Therefore, there is required technology capable of displaying an original image without change on the surface of a jewel in consideration of characteristics such as the refractive index, color, or depth of a jewel.

DISCLOSURE

Technical Problem

An object of the present invention is to generate an image identical to an original image on the surface of a jewel.

Further, another object of the present invention is to generate an image having the same color as an original image on the surface of a jewel.

Technical Solution

An apparatus for displaying an image on a surface of a jewel using a previously distorted image to accomplish the above objects includes a distorted image generation unit for generating a distorted image corresponding to an original image that is desired to be displayed on a table facet of a jewel in consideration of characteristics of the jewel and characteristics of the original image; and a display unit for outputting visible light corresponding to the distorted image to the jewel so that the original image is displayed on the table facet of the jewel.

Here, the distorted image generation unit may include a rendering unit for receiving the original image and rendering the jewel using a preset template; a correspondence relationship extraction unit for outputting virtual visible light corresponding to a first image from the table facet of the rendered jewel, analyzing a second image generated on a facet opposite the table facet by the virtual visible light, and extracting a correspondence relationship between the first image and the second image, based on a result of analysis; and a generation unit for generating the distorted image using the original image and the correspondence relationship.

Here, the distorted image generation unit may extract the correspondence relationship in consideration, of a refractive index, thickness, color, brightness, saturation, and number of crown facets of the jewel, and generate the distorted image by distorting the original image based on the correspondence relationship.

Here, the distorted image generation unit may generate the distorted image by distorting a part of the original image, corresponding to a portion in which the visible light passes through the jewel at a shorter length, more strongly than a part of the original image, corresponding to a portion in which the visible light passes through the jewel at a longer length.

Here, the distorted image generation unit may generate the distorter image by decreasing brightness of a color similar to a color of the jewel, among colors contained in the original image, and increasing brightness of a complementary color of the color of the jewel, among the colors contained in the original image.

Further, a method for displaying an image on a surface of a jewel using a previously distorted image according to an embodiment of the present invention includes generating a distorted image corresponding to an original image that is desired to be displayed on a table facet of a jewel in consideration of characteristics of the jewel and characteristics of the original image and outputting, visible light corresponding to the distorted image to the jewel so that the original image is displayed on the table facet of the jewel.

Here, generating the distorted image may include receiving the original image rendering the jewel using a preset template; outputting virtual visible light corresponding to a first image from the table facet of the rendered jewel, analyzing a second image generated on a facet opposite the table facet by the virtual visible light, and extracting a correspondence relationship between the first image and the second image, based on a result of analysis; and generating the distorted image using the original image and the correspondence relationship.

Here, generating the distorted image may be configured to extract the correspondence relationship in consideration of a refractive index, thickness, color, brightness, saturation, and number of crown facets of the jewel, and generate the distorted image by distorting the original image based on the correspondence relationship.

Here, generating the distorted image may be configured to generate the distorted image by distorting a part of the original image, corresponding to a portion in which the visible light passes through the jewel at a shorter length, more strongly than a part of the original image, corresponding to a portion in which the visible light passes through the jewel at a longer length.

Here, generating the distorted image may be configured to generate the distorted image by decreasing brightness of a color similar to a color of the jewel, among colors contained in the original image, and increasing brightness of a complementary color of the color of the jewel, among the colors contained in the original image.

Advantageous Effects

The present invention may generate an image identical to an original image on the surface of a jewel by outputting visible light, corresponding to a previously distorted image, into the jewel in consideration of the properties of visible light that is transformed while passing through the interior of the jewel.

Further, the present invention may generate a previously distorted image in consideration of the color of a jewel, so that visible light corresponding to the previously distorted image is output into the jewel, thus enabling an image having the same color as the original image to be generated on the surface of the jewel regardless of the color of the jewel.

DESCRIPTION OF DRAWINGS

FIGS. 5 to 9 are diagrams showing the characteristics of jewels in the templates used by the apparatus for displaying an image on the surface of a jewel using a previously distorted image according to the embodiment of the present invention;

BEST MODE

Figure 1:
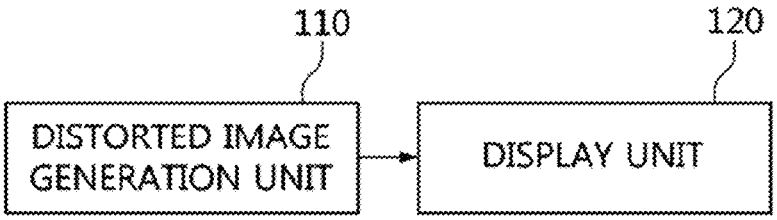
FIG. 1 is a block diagram showing an apparatus for displaying an image on the surface of a jewel using a previously distorted image according to an embodiment of the present invention.

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clearer.

Hereinafter, preferred embodiments of the present invention will be described in detail with reference to the attached drawings.

FIG. 1 is a block diagram showing an apparatus for displaying an image on the surface of a jewel according to an embodiment of the present invention.

Referring to FIG. 1, the apparatus for displaying an image on the surface of a jewel according to an embodiment of the present invention includes a distorted image generation unit 110 and a display unit 120.

The distorted image generation unit 110 generates a distorted image corresponding to an original image that is desired to be displayed on the table facet of a jewel in consideration of the characteristics of the jewel and the characteristics of the original image.

To display an image on the table facet of the jewel, there may be a method for directly displaying an image on the table facet. However, it is not easy to attach the image to the table facet, and the image does not appear to be transparent even if the image is attached to the table facet, thus greatly deteriorating an aesthetic sense.

In order to display an image on the table facet of a jewel, the present invention generates an image on the table facet by outputting visible light from the bottom surface of the table facet of the jewel. However, when the output visible light is incident on the jewel, an effect such as refraction occurs, by which a distorted image, rather than the originally intended image, is displayed. Therefore, the present invention generates a distorted image in advance, and outputs visible light corresponding to the distorted image, thus allowing the image displayed on the table facet of the jewel to be identical to the original image.

Here, since visible light is incident on the jewel, the color of the displayed image may also be distorted due to the refractive effect and the color of the jewel. The image is distorted in consideration of the distortion of color, and visible light corresponding to the distorted image is output, thus enabling the image displayed on the table facet of the jewel to be identical to the original image.

Here, the surface on which the jewel is attached to the setting and which is primarily viewed may be referred to as a 'table facet'. Further, the cut surfaces adjacent to the table facet may be referred to as 'crown facets'.

In this case, the characteristics of jewels may include the appearance, thickness, number of crown facets, refractive index, color, brightness, saturation, etc. of each jewel.

How images are to be distorted depending on the characteristics of jewels will be described in detail with reference to FIG. 2.

The display unit 120 outputs visible light corresponding to a distorted image so that the original image is displayed on the table facet of a jewel.

Although not shown in FIG. 1, the apparatus for displaying an image on the surface of a jewel according to an embodiment of the present invention may further include a communication unit (not shown).

Here, the communication unit may receive the original image via a communication means such as a wireless communication means.

The communication unit may receive templates or the like used by the distorted image generation unit.

Here, the types of communication means are not limited. It will be apparent that a WIFI, Bluetooth, Long Term Evolution (LTE) network, or the like may be used.

Figure 2:
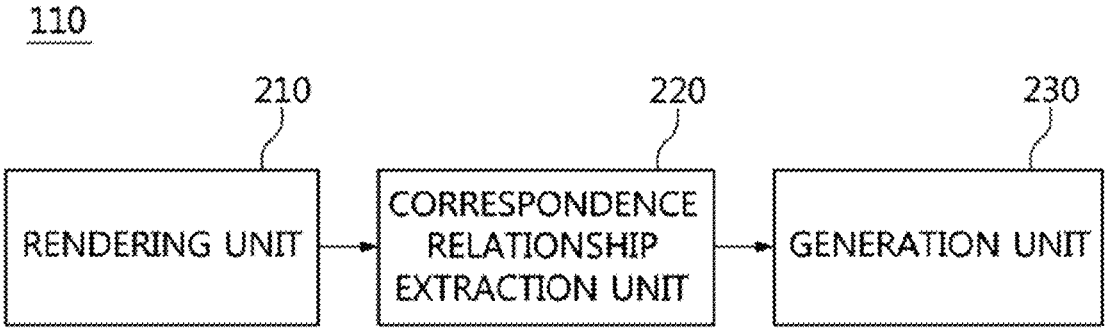
FIG. 2 is a block diagram showing the distorted image generation unit shown in FIG. 1.

FIG. 2 is a block diagram showing the distorted image generation unit shown in FIG. 1.

Referring to FIG. 2, the distorted image generation unit 110 includes a rendering unit 210, a correspondence relationship extraction unit 220, and a generation unit 230.

The rendering unit 210 receives an original image and renders a jewel using a preset template.

Such a template will be described in detail with reference to FIGS. 3 and 4.

Figure 3:
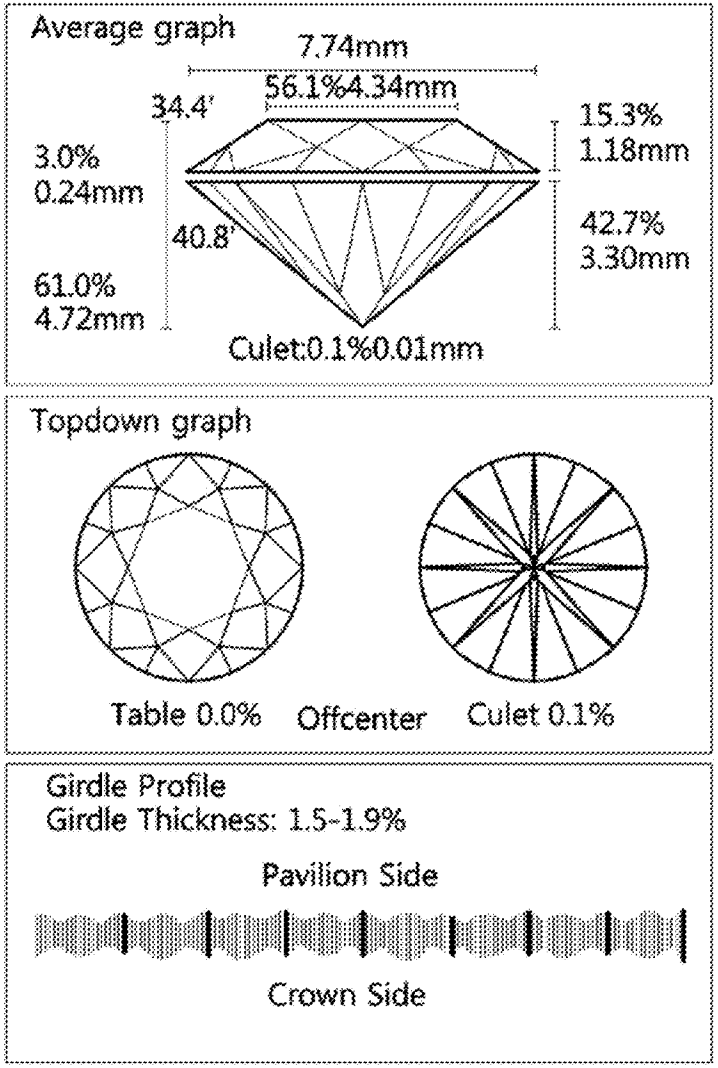
FIGS. 3 and 4 are diagrams showing templates used by the apparatus for displaying an image on the surface of a jewel using a previously distorted image according to the embodiment of the present invention.

Referring to FIG. 3, the template includes information about the appearance of each jewel, such as the weight of the jewel (est. weight), the diameter of the jewel, the depth of the jewel (total depth), the angle of the crown facets (crown angle), and the height of the crown facets (crown height).

Figure 4:
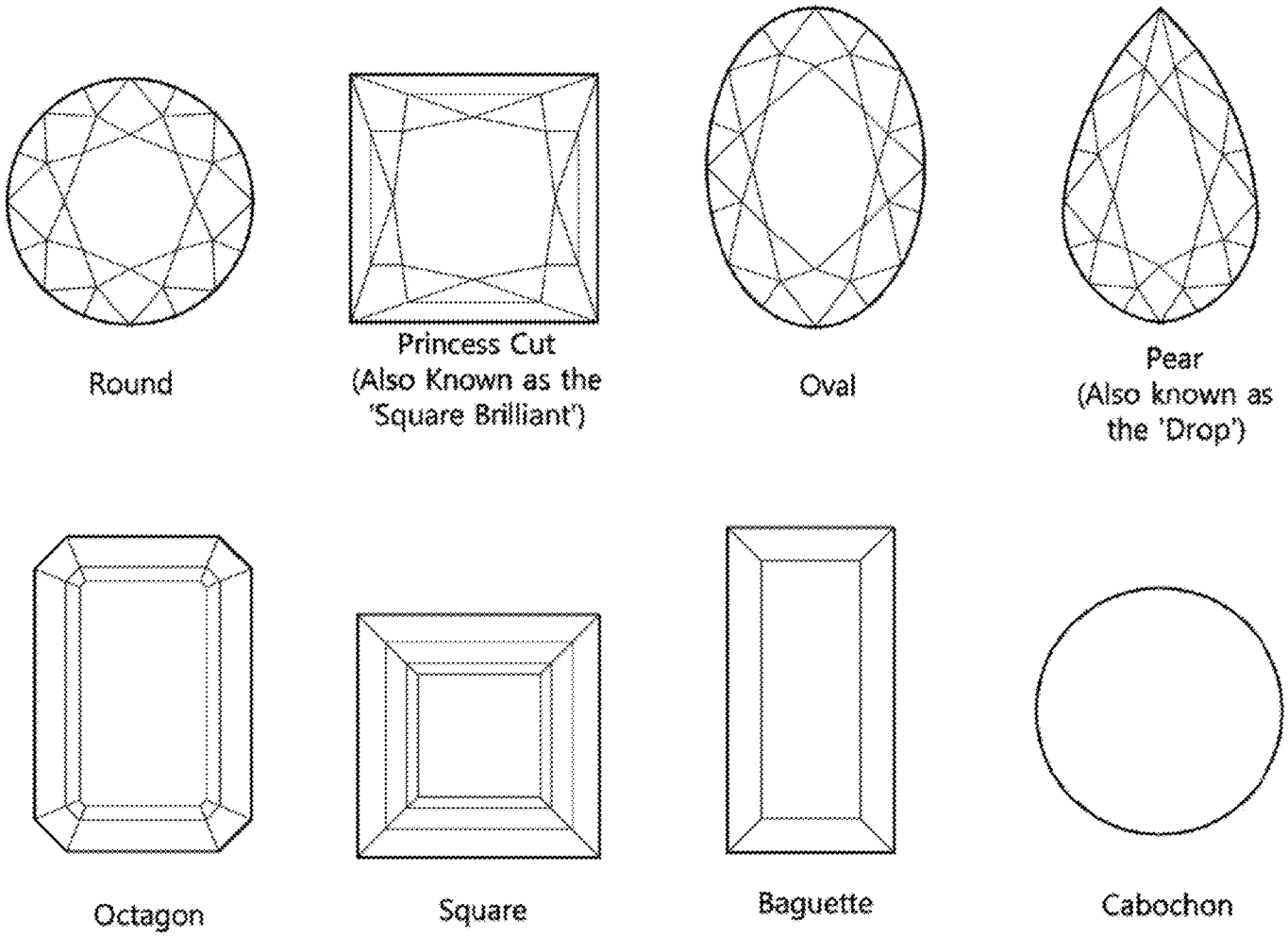

Further, referring to FIG. 4, the cutting types of jewels are illustrated.

That is, the template includes the cutting types of jewels and the information about the appearance of jewels shown in FIGS. 3 and 4.

Here, the template may be created using pieces of information generated by measuring the jewels, and the communication unit described in FIG. 1 may receive the template and allow the rendering unit 210 to use the template.

The rendering unit 210 may generate a virtual jewel by rendering a jewel based on the information present in the template.

Here, the rendering unit 210 may render the jewel to include the characteristics of the jewel, such as the internal refractive index and the color of the jewel, rather than rendering only the appearance of the jewel.

In this case, the characteristics of jewels may also be stored in the template. Referring to FIGS. 5 to 9, all characteristics, such as the color, transparency, luster, refractive index, polarization, ultraviolet fluorescence, gravity, hardness, chemical components, and crystal system of each jewel type, are stored in the template. Therefore, the interior of each jewel may also be rendered using the characteristics of the jewel, thus generating the virtual jewel.

Here, the virtual jewel may be used to extract a correspondence relationship between an original image and a distorted image when the distorted image is generated.

The correspondence relationship extraction unit 220 outputs virtual visible light corresponding to a first image from the table facet of the rendered jewel, analyzes a second image generated on the surface opposite the table facet by the virtual visible light, and then extracts a correspondence relationship between the first image and the second image.

Here, the second image means an image generated using the visible light corresponding to the first image, and a distorted image, which is not an image identical to the first image, is generated as the second image due to the internal characteristics of the jewel. That is, when a correspondence relationship between the second image and the first image may be extracted by analyzing the relationship therebetween, the relationship between the original image and the distorted image may be detected. Therefore, when the distorted image is generated and displayed using the correspondence relationship, an image identical to the original image may be generated on the table facet of the jewel.

More specifically, if the correspondence relationship between the first image and the second image is assumed to be 'A', a correspondence relationship that corresponds to the inverse function of 'A' may be extracted. A distorted image may be generated by distorting the first image using the correspondence relationship that corresponds to the inverse function. Here, when the distorted image is transmitted through the jewel, an image corresponding to the result of applying 'A' back to the inverse function may be displayed on the table facet of the jewel, and it is apparent that the displayed image will be identical to the displayed original image.

Here, the correspondence relationship extraction unit 220 may extract the correspondence relationship in consideration of the refractive index, thickness, colors, brightness, saturation, and number of crown facets of the corresponding jewel.

The greater the refractive index of the jewel, the more the original image is inevitably distorted, and the more severely the original image must be distorted in order to generate a previously distorted image.

Further, when light passes through a colored jewel, rather than a colorless transparent jewel, a color matching the color of the jewel may be further emphasized, and then the distorted image may be generated. Thus, when a distorted image is generated by distorting the original image, the distorted image may be generated by decreasing the brightness of colors similar to the color of the jewel and increasing the brightness of the complementary color of the color of the jewel. This will be described in detail with reference to FIG. 15.

Furthermore, an image may also pass through the crown part of the jewel (the side part of the jewel). In this case, a correspondence relationship may be extracted in consideration of the number of crown facets. A description thereof will be made with reference to FIGS. 18 and 19.

Figure 20:
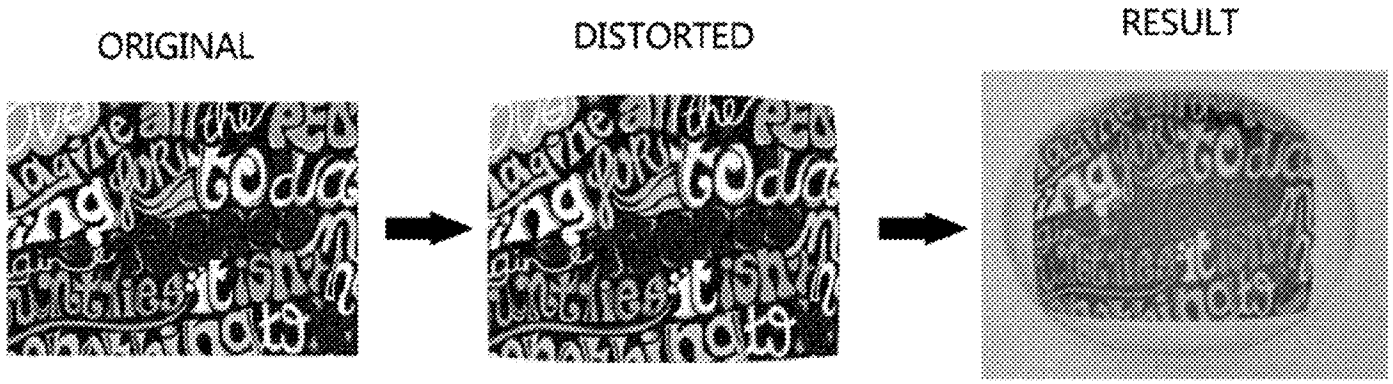
FIGS. 20 to 23 are diagrams showing examples in which the apparatus for displaying an image on the surface of a jewel using a previously distorted image according to the embodiment of the present invention generates distorted images depending on the thickness of jewels.
Figure 21:
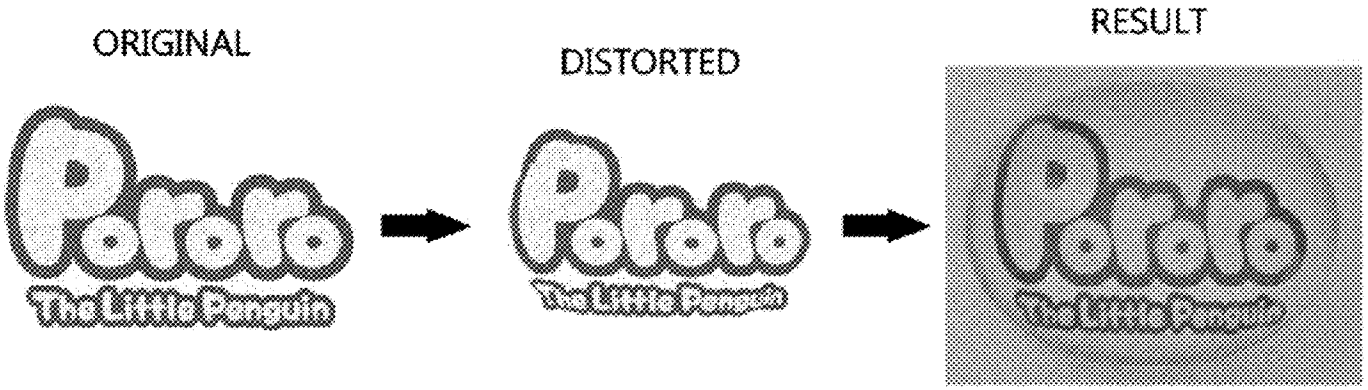

Meanwhile, a correspondence relationship may be extracted in consideration of the thickness of the jewel. The reason for this is that, as the jewel is thicker, the length at which visible light passes through the jewel is larger, and thus the degree of distortion at an image part. Corresponding to a portion in which visible light passes through the jewel at a shorter length and the degree of distortion at an image part corresponding to a portion in which the visible light passes through the jewel at a longer length differ from each other. Typically, a distorted image may be generated by distorting the part of the original image, corresponding to the portion in which visible light passes at a shorter length, more strongly than the part of the original image, corresponding to the portion in which the visible light passes at a longer length. A description thereof will be made with reference to FIGS. 20 and 21.

The generation unit 230 generates the distorted image using both the original image and the correspondence relationship.

Figure 10:
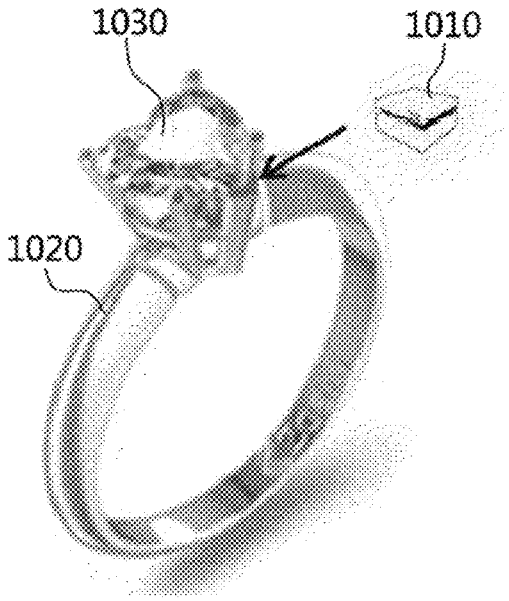
FIGS. 10 and 11 are diagrams showing examples in which the apparatus for displaying an image on the surface of a jewel using a previously distorted image according to the embodiment of the present invention is inserted into a space between the jewel and a setting.
Figure 11:
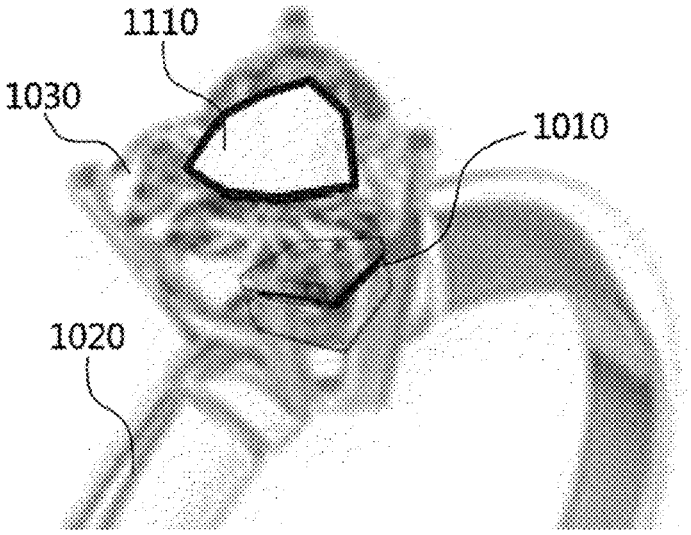

FIGS. 10 and 11 are diagrams showing examples in which the apparatus for displaying an image on the surface of a jewel according to the embodiment of the present invention is inserted into a space between the jewel and a setting.

Referring to FIG. 10, it can be seen that an apparatus 1010 for displaying an image on the surface of a jewel according to an embodiment of the present invention is inserted into the space between a jewel 1030 and a setting 1020.

Here, the setting 1020 is attached to the jewel 1030, and a circular ring is indicated as the setting 1020 in FIG. 10, but the shape of the setting is not especially limited.

FIG. 11 is a diagram showing in greater detail the attachment of the apparatus 1010 for displaying an image on the surface of a jewel, as shown in FIG. 10.

Referring to FIG. 11, the apparatus 1010 for displaying an image on the surface of a jewel is inserted into the space between a setting 1020 and a jewel 1030.

Here, the apparatus 1010 for displaying an image on the surface of a jewel outputs visible light, corresponding to the distorted image generated using the method described above with reference to FIGS. 1 and 2, towards the table 1110 of the jewel.

Here, as the visible light passes through the interior of the jewel, the properties of the output visible light change depending on the internal characteristics of the jewel, such as the refractive index and transmissivity of the jewel.

Here, the visible light, the properties of which have changed, reaches the table 1110 of the jewel, and an image is generated on the table.

The image generated on the table 1110 of the jewel is an image which is generated by distorting again the previously distorted image. In this case, the image may be identical to the original image.

Figure 12:
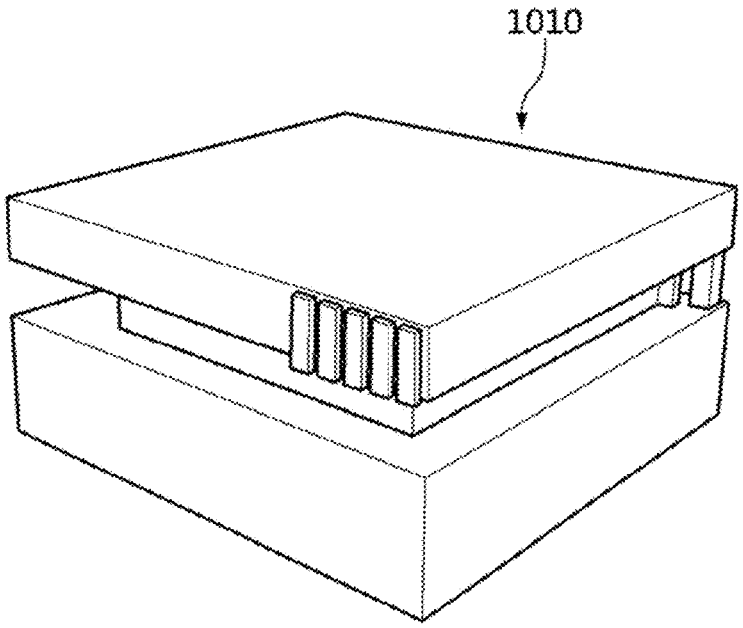
FIGS. 12 to 14 are diagrams showing the apparatus for displaying an image on the surface of a jewel using a previously distorted image according to the embodiment of the present invention.
Figure 13:
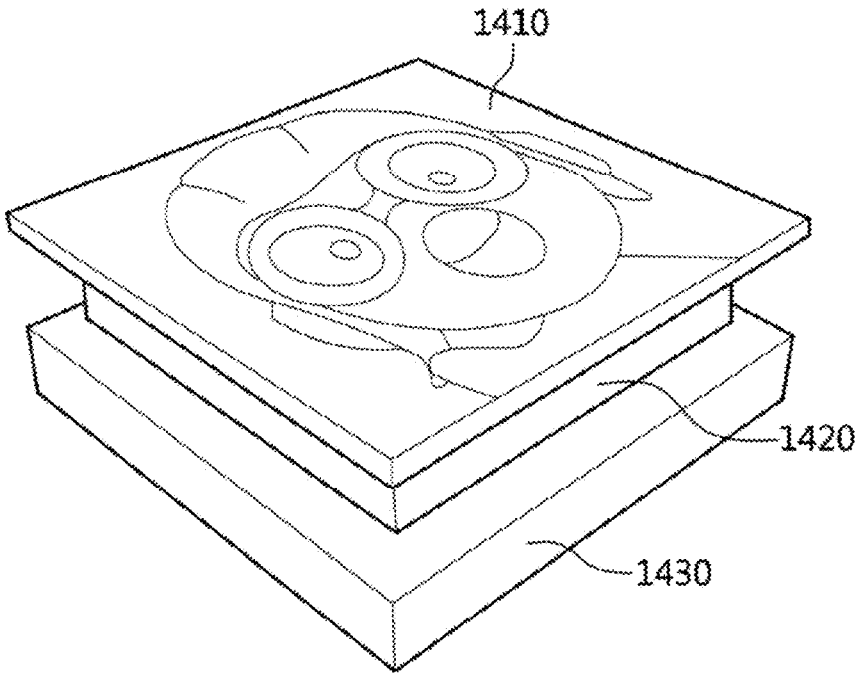
Figure 14:
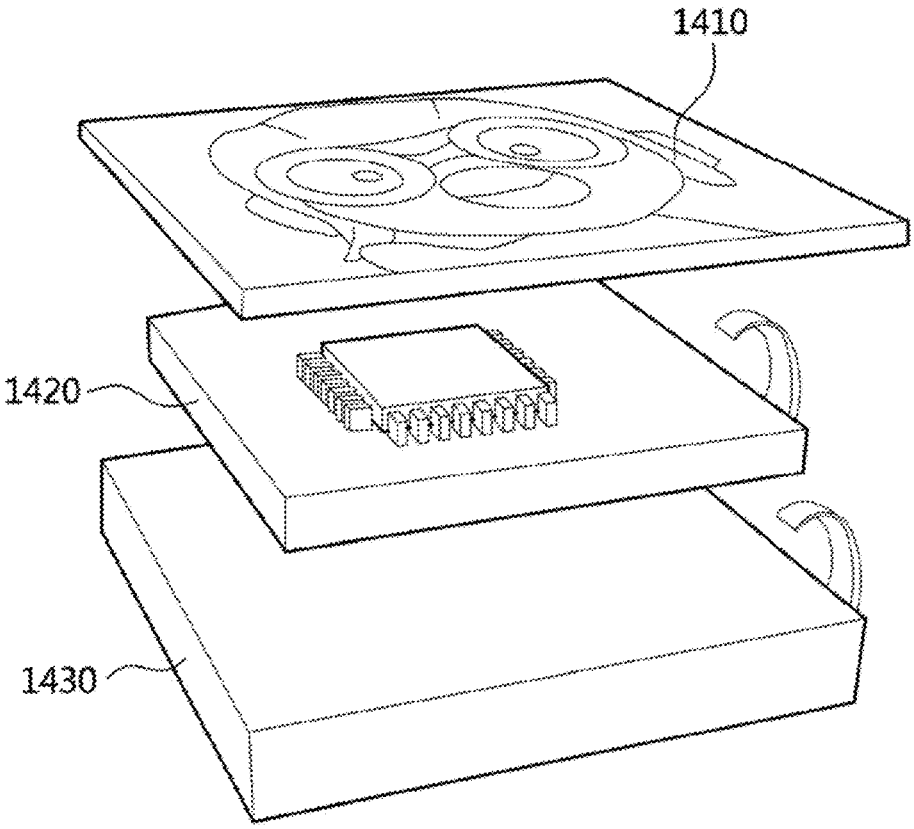

FIGS. 12 to 14 are diagrams showing the apparatus for displaying an image on the surface of a jewel according to the embodiment of the present invention.

Referring to FIG. 12, the apparatus for displaying an image on the surface of a jewel according to an embodiment of the present invention may be formed in the shape of a rectangular parallelepiped having a width of 3 mm, a length of 3 mm, and a height of 4 mm. However, it is apparent that the apparatus may be manufactured in various shapes without being limited as to the size thereof, and may be manufactured in different shapes depending on the space between a jewel and a setting.

FIG. 13 is a view showing in greater detail the apparatus for displaying an image on the surface of a jewel, as shown in FIG. 12, wherein three parts may be combined to form the apparatus. A description thereof will be made below with reference to FIG. 14.

FIG. 14 is a view showing the apparatus for displaying an image on the surface of a jewel according to an embodiment of the present invention. Referring to FIG. 14, the apparatus includes a display unit 1410, a semiconductor 1420, and a battery 1430.

The display unit 1410 may function to display a distorted image generated by the distorted image generation unit 110 shown in FIG. 1.

Here, the type of display unit 1410 is not especially limited. The display unit may be implemented using a Liquid Crystal Display (LCD) or a Light-Emitting Diode (LED), and the scheme for manufacturing the display unit 1410 may also vary depending on the characteristics of the jewel.

The semiconductor 1420 is a part in which the distorted image generation unit 110 for generating a distorted image is implemented m the apparatus for displaying an image on the surface of a jewel according to the embodiment of the present invention.

Here, the semiconductor 1420 may be manufactured using a Printed Circuit Board (PCB), and an Internet of Things (IoT) chip may be inserted into the semiconductor. Further, a communication chip may also be inserted so as to perform a communication function.

The battery 1430 is a part for supplying required power in the apparatus for displaying an image on the surface of a jewel according to the embodiment of the present invention.

Here, the type of battery 1430 is not especially limited, and the method for charging the battery 1430 is not especially limited, either. In the case of the present invention, charging may be performed using wired charging, and may also be performed using a wireless charging function, which has been recently popularized.

Figure 15:
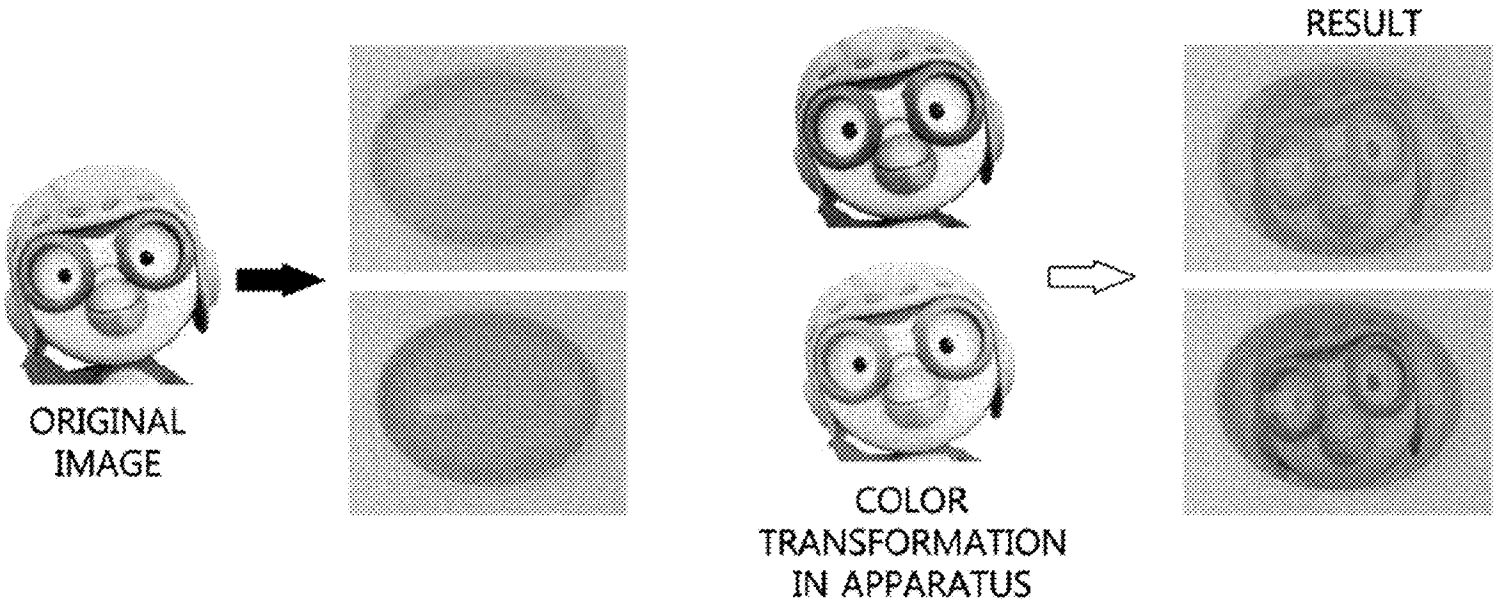
FIG. 15 is a diagram showing an example in which the apparatus for displaying an image on the surface of a jewel using a previously distorted image according to the embodiment of the present invention generates distorted images depending on the colors of jewels.

FIG. 15 is a diagram showing an example in which the apparatus for displaying an image on the surface of a jewel according to the embodiment of the present invention generates distorted images depending on the colors of jewels.

Referring to FIG. 15, there are a jewel having an emerald-based color and a jewel having a ruby-based color.

First, when visible light corresponding to an original image is displayed on each jewel without change, a distorted image is displayed on the surface of the jewel. Therefore, the distorted image generation unit 110 shown in FIG. 1 outputs visible light corresponding to a previously generated distorted image, thus enabling an image identical to the original image to be displayed on the surface of the jewel.

However, in the case of the jewel having an emerald-based color, when an original image is displayed without change, the effect of distorting the original image while further emphasizing a greenish color, among the colors contained in the original image, may appear. Therefore, the distorted image generation unit 110 may generate a distorted image by decreasing the brightness of the greenish color and increasing the brightness of a reddish color, which is the complementary color of the greenish color, or the brightness of a bluish color.

Therefore, when visible light corresponding to the distorted image generated by increasing the brightness of the reddish color or the bluish color, is output to the jewel having the emerald-based color, an image having the same color as the original image may be displayed on the surface of the jewel.

Further in the case of the jewel having the ruby-based color, the effect of distorting the original image while further emphasizing a reddish color, among the colors contained in the original image, may appear. Therefore, the distorted image generation unit 110 may generate a distorted image by decreasing the brightness of the reddish color and increasing the brightness of a greenish color, and may output visible light corresponding to the distorted image to the jewel, thus enabling an image having the same color as the original image to be displayed.

Figure 16:
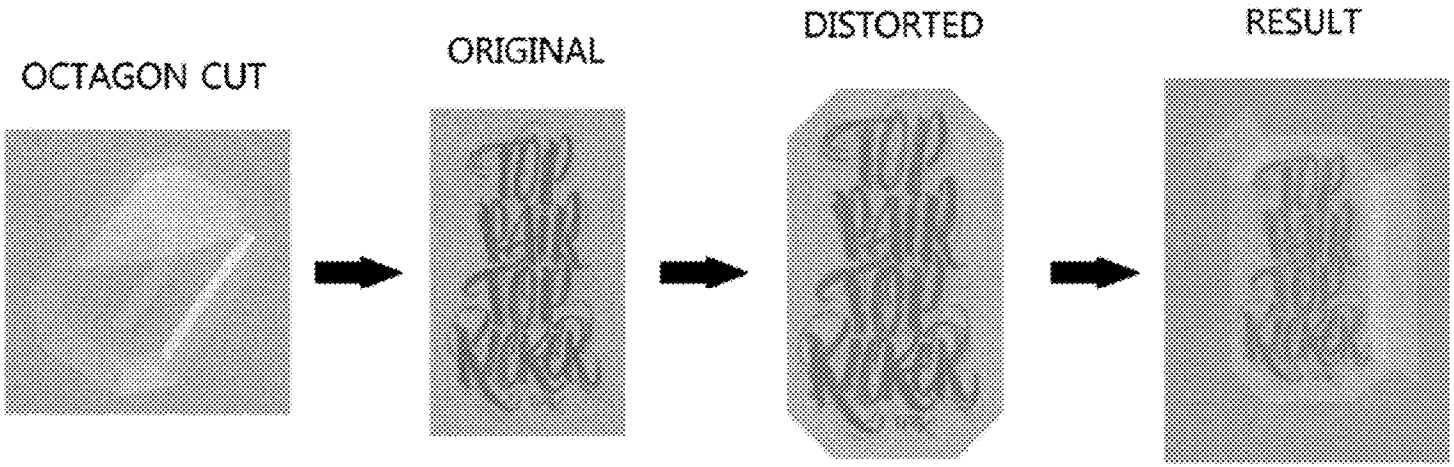
FIGS. 16 and 17 are diagrams showing examples in which the apparatus for displaying an image on the surface of a jewel using a previously distorted image according to the embodiment of the present invention generates distorted images depending on jewels having different shapes that are generated through different types of cutting.
Figure 17:
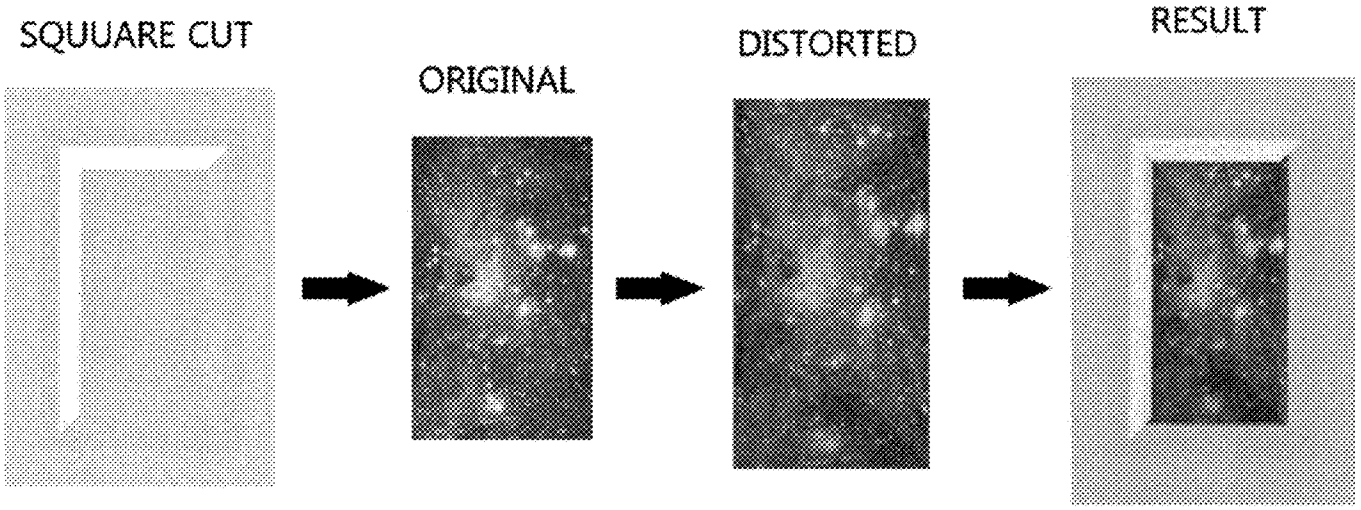

FIGS. 16 and 17 are diagrams showing examples in which the apparatus for displaying an image on the surface of a jewel according to the embodiment of the present invention generates distorted images depending on jewels having different shapes that are generated through different types of cutting.

FIG. 16 illustrates the case where a distorted image is generated in an octagonal jewel (jewel with an octagon cut) and visible light corresponding to the distorted image is output, and then an image identical to the original image is displayed while the visible light passes through the jewel and is transformed therethrough.

In the case of the jewel with the octagon cut, the center portion thereof is formed to be higher than the edge portion thereof. Therefore, a distorted image is generated by distorting the edge portion more strongly than the center portion, and visible light corresponding to the distorted image is output to the jewel with the octagon cut. Here, the visible light undergoes transformation, such as refraction, while passing through the interior of the jewel. When the visible light reaches the surface of the jewel with the octagon cut and an image is displayed, the displayed image is identical to the original image.

FIG. 17 illustrates the case where a distorted image is generated in a rectangular jewel (jewel with a baguette cut) and visible light corresponding to the distorted image is output, and then an image identical to the original image is displayed while the visible light passes through the jewel and is transformed therethrough.

In the case of the jewel with the baguette cut, the center portion thereof is formed to be higher than the edge portion thereof, similar to the jewel with the octagon cut. Therefore, a distorted image is generated by distorting the edge portion more strong than the center portion, and visible light corresponding to the distorted image is output to the jewel with the baguette cut. In this case, visible light undergoes transformation, such as refraction, while passing through the interior of the jewel. As the transformed visible light reaches the surface of the jewel with the baguette cut, an image is generated, and is then identical to the original image.

Figure 18:
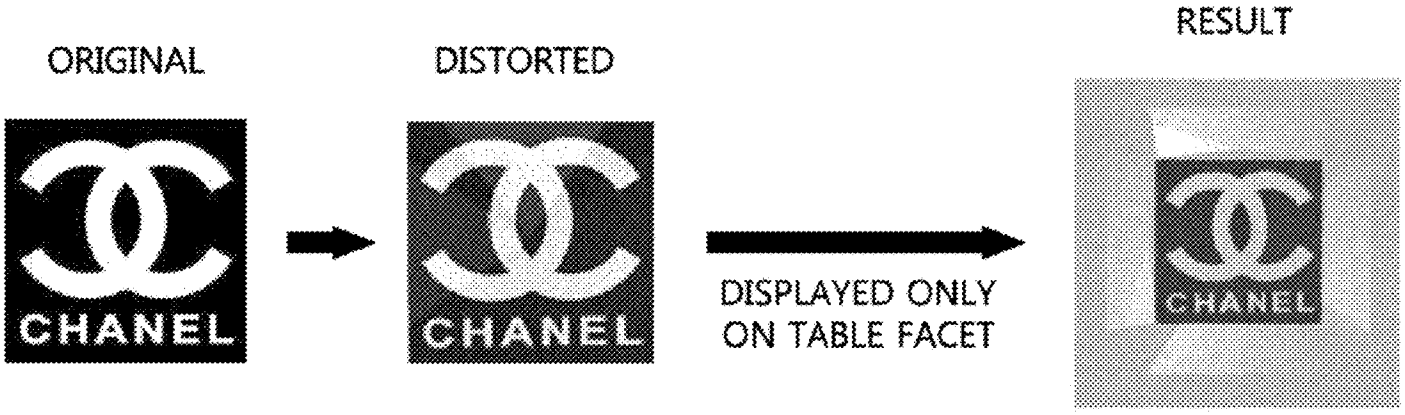
FIGS. 18 and 19 are diagrams showing examples in which the apparatus for displaying an image on the surface of a jewel using a previously distorted image according to the embodiment of the present invention generates distorted images depending on the table part and the crown part of jewels.
Figure 19:
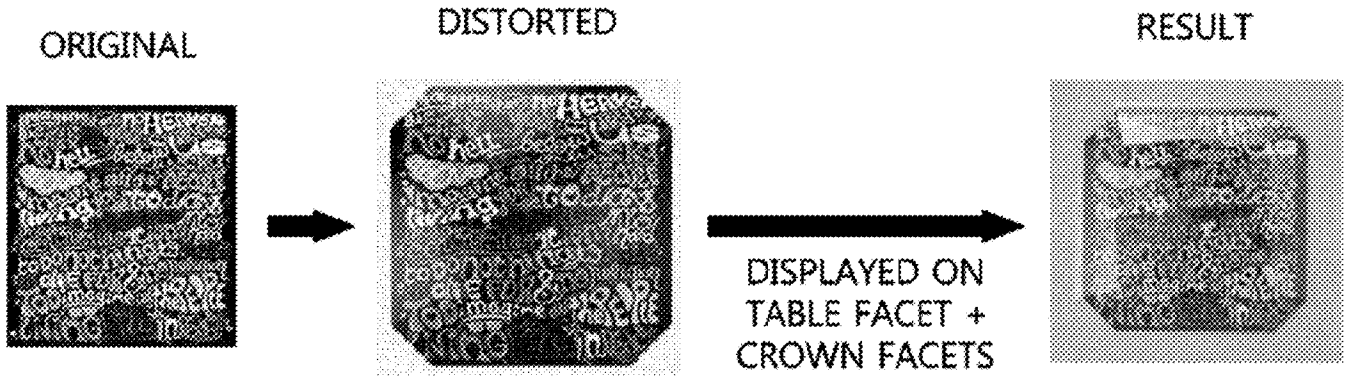

FIGS. 18 and 19 are diagrams showing examples in which the apparatus for displaying an image on the surface of a jewel according to the embodiment of the present invention generates distorted images depending on the table part and the crown part of jewels.

FIG. 18 illustrates the case where an image is displayed only on the table facet of a jewel, and FIG. 19 illustrates the case where an image is displayed on both the table facet and the crown facets of a jewel.

The apparatus for displaying an image on the surface of a jewel according to the embodiment of the present invention may generate a distorted image by distorting an original image in consideration of both the crown facets and the table facet of the jewel and may display an image identical to the original image on the surface of the jewel using the distorted image.

FIGS. 20 to 23 are diagrams showing examples in which the apparatus for displaying an image on the surface of a jewel according to the embodiment of the present invention generates distorted images depending on the thickness of jewels.

Figure 22:
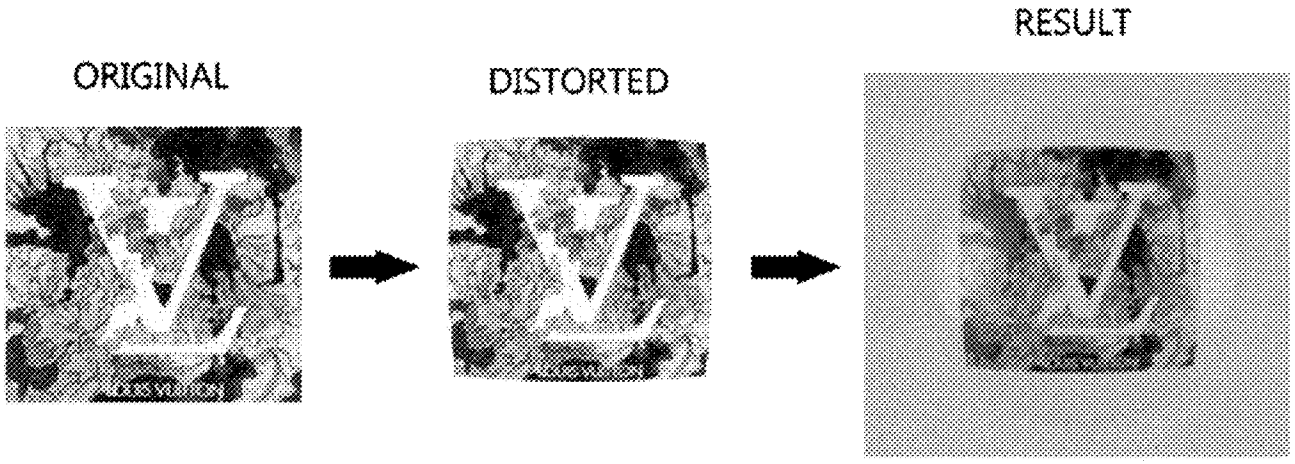
Figure 23:
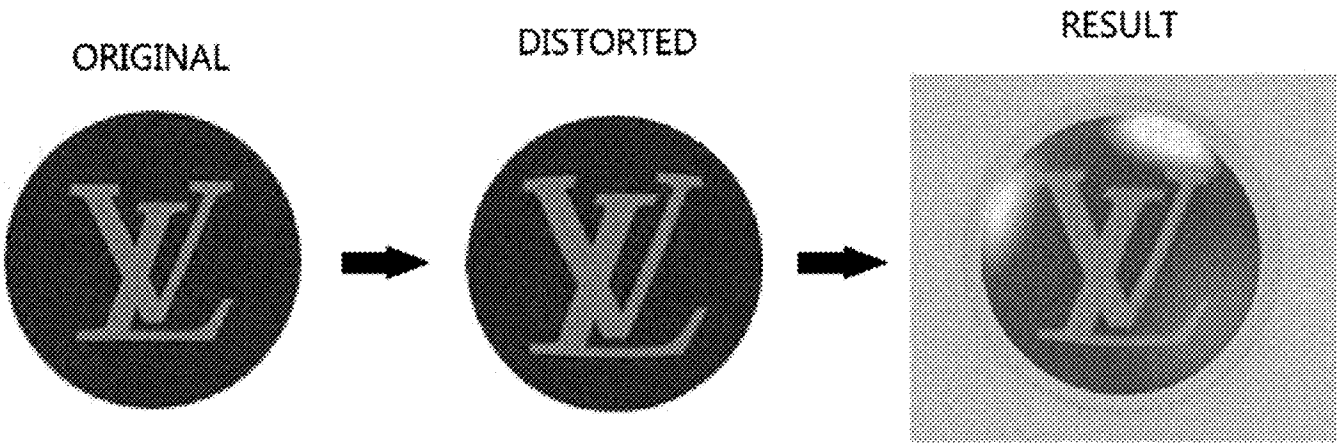

The jewels shown in FIGS. 20 to 23 are jewels with oval cabochon cuts (FIGS. 20 and 21) or round cabochon cuts (FIGS. 22 and 23).

Typically, jewels with oval or round cabochon cuts are designed such that center portions thereof are formed to be higher than edge portions thereof. Therefore, visible light passing through the interior of the jewels moves along a relatively straight path in the center portions, but is refracted in a radial direction in the edge portions. In particular, the degree to winch visible light is refracted becomes stronger in a direction from the center portions to the edge portions, and thus the visible light is further radially extended in the edge portions.

Therefore, a distorted image is generated by distorting the part of the original image corresponding to an edge portion, having a smaller height, more strongly than the part of the original image corresponding to a portion, having a larger height, and visible light corresponding to the distorted image is output, thus enabling the image displayed on the surface of a jewel to be identical to the original image.

Figure 24:
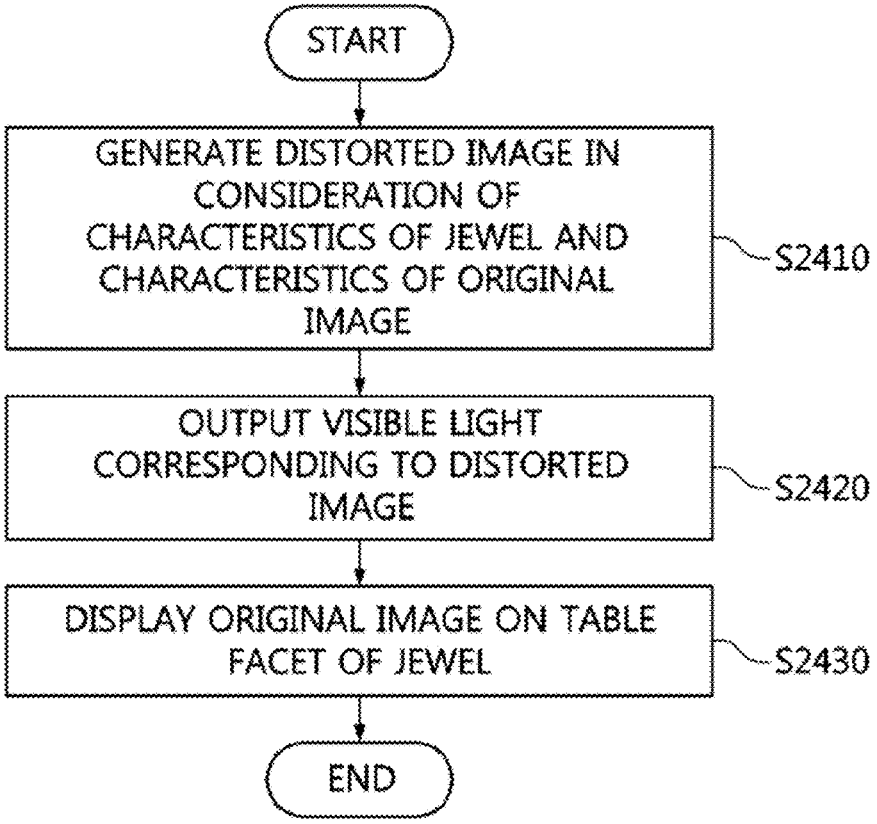
FIG. 24 is an operation flowchart showing a method for displaying an image on the surface of a jewel using a previously distorted image according to an embodiment of the present invention.

FIG. 24 is an operation flowchart showing a method for displaying an image on the surface of a jewel according to an embodiment.

Referring to FIG. 24, a distorted image is generated in consideration of the characteristics of a jewel and the characteristics of an original image at step S2410.

To display an image on the table facet of the jewel, there may be a method for directly displaying an image on the table facet. However, it is not easy to attach the image to the table facet, and the image does not appear to be transparent even if the image is attached to the table facet, thus greatly deteriorating an aesthetic sense.

In order to display an image on the table facet of a jewel, the present invention generates an image on the table facet by outputting visible light from the bottom surface of the table facet of the jewel. However, when the output visible light is incident on the jewel, an effect such as refraction occurs, by which a distorted image, rather than the originally intended image, is displayed. Therefore, the present invention generates a distorted image in advance, and outputs visible light corresponding to the distorted image, thus allowing the image displayed on the table facet of the jewel to be identical to the original image.

Here, since visible light is incident on the jewel, the color of the displayed image may also be distorted due to the retractive effect and the color of the jewel. The image is distorted in consideration of the distortion of color, and visible light corresponding to the distorted image is output, thus enabling the image displayed on the table facet of the jewel to be identical to the original image.

Here, the surface on which the jewel is attached to the setting and which is primarily viewed may be referred to as a 'table facet'. Further, the cut surfaces adjacent to the table facet may be referred to as 'crown facets'.

In this case, the characteristics of jewels may include the appearance, thickness, number of crown facets, refractive index, color, brightness, saturation, etc. of each jewel.

How images are to be distorted depending on the characteristics of jewels has been described in detail with reference to FIG. 2.

Further, visible light corresponding to the distorted image is output at step S2420.

In this case, the visible light may be output from a light source present in the space between the jewel and a setting.

Next, an original image is generated on the table facet of the jewel while visible light passes through the interior of the jewel at step S2430.

Here, transformation such as refraction occurs due to the characteristics of the jewel while the visible light passes through the interior a the jewel. However, the visible light corresponding to the distorted image, generated by performing step S2410, undergoes transformation due to the characteristics of the jewel, and thereafter an image is displayed on the table facet of the jewel. The image displayed in this case corresponds to the original image. The reason for this is that the distorted image is generated so that the image displayed after the transformation has occurred corresponds to the original image.

As described above, in the apparatus and method for displaying an image on the surface of a jewel using a previously distorted image according to the present invention, the configurations and schemes in the above-described embodiments are not limitedly applied, and some or all of the above embodiments can be selectively combined and configured so that various modifications are possible.

INDUSTRIAL APPLICABILITY

The present invention enables an image identical to the original image to be generated on the surface of a jewel by outputting visible light corresponding to a previously distorted image into the jewel in consideration of the properties of visible light that is transformed while passing through the interior of the jewel, thus causing an aesthetic sense that has not been provided by jewelry products such as rings, and forming new jewelry product markets due to the application of the present invention to various jewelry products.

The invention claimed is:

1. An apparatus for displaying an image on a surface of a jewel using a previously distorted image, comprising:

a distorted image generation unit for generating a distorted image corresponding to an original image that is desired to be displayed on a table facet of a jewel in consideration of characteristics of the jewel and characteristics of the original image, wherein the distorted image generation unit comprises:

a rendering unit for receiving the original image and rendering the jewel using a preset template;

a correspondence relationship extraction unit for outputting virtual visible light corresponding to a first image from the table facet of the rendered jewel, analyzing a second image generated on a facet opposite the table facet by the virtual visible light, and extracting a correspondence relationship between the first image and the second image, based on a result of analysis; and a generation unit for generating the distorted image using the original image and the correspondence relationship; and a display unit for outputting visible light corresponding to the distorted image to the jewel so that the original image is displayed on the table facet of the jewel.

2. The apparatus of claim 1, wherein the distorted image generation unit extracts the correspondence relationship in consideration of a refractive index, thickness, color, brightness, saturation, and number of crown facets of the jewel, and generates the distorted image by distorting the original image based on the correspondence relationship.

3. The apparatus of claim 2, wherein the distorted image generation unit generates the distorted image by distorting a part of the original image, corresponding to a portion in which the visible light passes through the jewel at a shorter length, more strongly than a part of the original image, corresponding to a portion in which the visible light passes through the jewel at a longer length.

4. The apparatus of claim 2, wherein the distorted image generation unit generates the distorted image by decreasing brightness of a color similar to a color of the jewel, among colors contained in the original image, and increasing brightness of a complementary color of the color of the jewel, among the colors contained in the original image.

5. A method for displaying an image on a surface of a jewel using a previously distorted image, comprising:

generating a distorted image corresponding to an original image that is desired to be displayed on a table facet of a jewel in consideration of characteristics of the jewel and characteristics of the original image, wherein generating the distorted image comprises:

receiving the original image;

rendering the jewel using a preset template;

outputting virtual visible light corresponding to a first image from the table facet of the rendered jewel, analyzing a second image generated on a facet opposite the table facet by the virtual visible light, and extracting a correspondence relationship between the first image and the second image, based on a result of analysis; and generating the distorted image using the original image and the correspondence relationship; and outputting visible light corresponding to the distorted image to the jewel so that the original image is displayed on the table facet of the jewel.

6. The method of claim 5, wherein generating the distorted image is configured to extract the correspondence relationship in consideration of a refractive index, thickness, color, brightness, saturation, and number of crown facets of the jewel, and generate the distorted image by distorting the original image based on the correspondence relationship.

7. The method of claim 6, wherein generating the distorted image is configured to generate the distorted image by distorting a part of the original image, corresponding to a portion in which the visible light passes through the jewel at a shorter length, more strongly than a part of the original image, corresponding to a portion in which the visible light passes through the jewel at a longer length.

8. The method of claim 6, wherein generating the distorted image is configured to generate the distorted image by decreasing brightness of a color similar to a color of the jewel, among colors contained in the original image, and increasing brightness of a complementary color of the color of the jewel, among the colors contained in the original image.

* * * * *